US011325128B2

(12) United States Patent
Geng et al.

(10) Patent No.: US 11,325,128 B2
(45) Date of Patent: May 10, 2022

(54) DIGITAL MICROFLUIDIC DEVICE, MICROFLUIDIC DEVICE, LAB-ON-A-CHIP DEVICE, DIGITAL MICROFLUIDIC METHOD, AND METHOD OF FABRICATING DIGITAL MICROFLUIDIC DEVICE

(71) Applicants: BEIJING BOE OPTOELECTRONICS TECHNOLOGY CO., LTD., Beijing (CN); BOE Technology Group Co., Ltd., Beijing (CN)

(72) Inventors: Yue Geng, Beijing (CN); Peizhi Cai, Beijing (CN); Chuncheng Che, Beijing (CN); Fengchun Pang, Beijing (CN)

(73) Assignees: BOE Technology Group Co., Ltd., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 391 days.

(21) Appl. No.: 16/464,603

(22) PCT Filed: Jun. 29, 2018

(86) PCT No.: PCT/CN2018/093584
§ 371 (c)(1),
(2) Date: May 28, 2019

(87) PCT Pub. No.: WO2020/000352
PCT Pub. Date: Jan. 2, 2020

(65) Prior Publication Data
US 2020/0330995 A1 Oct. 22, 2020

(51) Int. Cl.
*B01L 3/00* (2006.01)

(52) U.S. Cl.
CPC . *B01L 3/502792* (2013.01); *B01L 2400/0427* (2013.01)

(58) Field of Classification Search
None
See application file for complete search history.

(56) References Cited

U.S. PATENT DOCUMENTS

2007/0241068 A1* 10/2007 Pamula ..... B01L 3/502715 210/806
2011/0174082 A1 7/2011 Achard et al.

FOREIGN PATENT DOCUMENTS

CN 103143406 A 6/2013
CN 103386332 A * 11/2013
(Continued)

OTHER PUBLICATIONS

International Search Report & Written Opinion dated Apr. 3, 2019, regarding PCT/CN2018/093584.

*Primary Examiner* — J. Christopher Ball
(74) *Attorney, Agent, or Firm* — Intellectual Valley Law, P.C.

(57) ABSTRACT

The present application provides a digital microfluidic device. The digital microfluidic device includes a base substrate; and an electrode array including a plurality of discrete electrodes continuously arranged on the base substrate. The plurality of discrete electrodes can be grouped into a plurality of first electrode groups, each of which including a plurality of directly adjacent discrete electrodes. The plurality of discrete electrodes can be alternatively grouped into a plurality of second electrode groups, each of which including a plurality of directly adjacent discrete electrodes.

18 Claims, 14 Drawing Sheets

(56) References Cited

FOREIGN PATENT DOCUMENTS

| | | | |
|---|---|---|---|
| CN | 103386332 | A | 11/2013 |
| CN | 103406162 | A | 11/2013 |
| WO | 2009004533 | A1 | 1/2009 |

* cited by examiner

DIGITAL MICROFLUIDIC DEVICE, MICROFLUIDIC DEVICE, LAB-ON-A-CHIP DEVICE, DIGITAL MICROFLUIDIC METHOD, AND METHOD OF FABRICATING DIGITAL MICROFLUIDIC DEVICE

CROSS-REFERENCE TO RELATED APPLICATION

This application is a national stage application under 35 U.S.C. § 371 of International Application No. PCT/CN2018/093584, filed Jun. 29, 2018, the contents of which are incorporated by reference in the entirety.

TECHNICAL FIELD

The present invention relates to microfluidic technology, more particularly, to a digital microfluidic device, a microfluidic device, a lab-on-a-chip device, a digital microfluidic method, and a method of fabricating a digital microfluidic device.

BACKGROUND

Microfluidics enables precise control and manipulation of fluids that are geometrically constrained to small volumes (e.g., microliter-scale). Microfluidics can transform routine bioassays into rapid and reliable tests due to its rapid kinetics and the potential for automation. Digital microfluidics has been developed for miniaturized bioassays. The technique enables manipulation of discrete droplets of fluids across a surface of patterned electrodes. Using digital microfluidics, array-based bioassays can be easily performed to conduct various biochemical reactions by merging and mixing those droplets. Moreover, large, parallel scaled, multiplexed analyses can be performed using digital microfluidics. Digital microfluidics has found a wide variety of applications including cell-based assays, enzyme assays, protein profiling, and the polymerase chain reaction.

SUMMARY

In one aspect, the present invention provides a digital microfluidic device, comprising a base substrate; and an electrode array including a plurality of discrete electrodes continuously arranged on the base substrate; wherein the plurality of discrete electrodes can be grouped into a plurality of first electrode groups, each of which comprising a plurality of directly adjacent discrete electrodes; a cross-section of each individual group of the plurality of first electrode groups along a plane substantially parallel to a main surface of the base substrate has an overall shape having a recess on one side, and a protrusion on an opposite side protruding toward a first direction; the plurality of discrete electrodes can be alternatively grouped into a plurality of second electrode groups, each of which comprising a plurality of directly adjacent discrete electrodes; a cross-section of each individual group of the plurality of second electrode groups along the plane substantially parallel to the main surface of the base substrate has an overall shape having a recess on one side, and a protrusion on an opposite side protruding toward a second direction; the first direction and the second direction are different from each other.

Optionally, the cross-section of each individual group of the plurality of first electrode groups along the plane substantially parallel to the main surface of the base substrate has an overall shape of a first convex-concave shape, a convex side of the first convex-concave shape protruding toward the first direction; and the cross-section of each individual group of the plurality of second electrode groups along the plane substantially parallel to the main surface of the base substrate has an overall shape of a second convex-concave shape, a convex side of the second convex-concave shape protruding toward the second direction.

Optionally, the plurality of discrete electrodes can be alternatively grouped into a plurality of biconcave electrode groups and a plurality of biconvex electrode groups alternately arranged; a cross-section of each individual one group of the plurality of biconcave electrode groups along the plane substantially parallel to the main surface of the base substrate has an overall shape of a biconcave shape; and a cross-section of each individual one group of the plurality of biconvex electrode groups along the plane substantially parallel to the main surface of the base substrate has an overall shape of a biconvex shape.

Optionally, each individual one group of the plurality of biconcave electrode groups is directly adjacent to one or more groups of the plurality of biconvex electrode groups; and each individual one group of the plurality of biconvex electrode groups is directly adjacent to one or more groups of the plurality of biconcave electrode groups.

Optionally, each individual one group of the plurality of biconcave electrode groups has a boundary substantially complementary to, and insulated from, corresponding portions of directly adjacent one or more groups of the plurality of biconvex electrode groups; and each individual one group of the plurality of biconvex electrode groups has a boundary substantially complementary to, and insulated from, corresponding portions of directly adjacent one or more groups of the plurality of biconcave electrode groups.

Optionally, each individual one group of the plurality of biconcave electrode groups consists of a single biconcave electrode; and each individual one group of the plurality of biconvex electrode groups consists of a single biconvex electrode.

Optionally, each individual one group of the plurality of biconcave electrode groups has a boundary substantially complementary to, and insulated from, corresponding portions of directly adjacent one or more groups of the plurality of biconvex electrode groups; and each individual one group of the plurality of biconvex electrode groups has a boundary substantially complementary to, and insulated from, corresponding portions of directly adjacent one or more groups of the plurality of biconcave electrode groups.

Optionally, the digital microfluidic device further comprises a plurality of first signal lines and a plurality of second signal lines; wherein the plurality of first signal lines are respectively connected to the plurality of first electrode groups, each individual one of the plurality of first signal lines being connected to all of directly adjacent discrete electrodes in a respective one of the plurality of first electrode groups; and the plurality of second signal lines are respectively connected to the plurality of second electrode groups, each individual one of the plurality of second signal lines being connected to all of directly adjacent discrete electrodes in a respective one of the plurality of second electrode groups.

Optionally, the digital microfluidic device further comprises a plurality of first signal lines and a plurality of second signal lines; wherein a first directly adjacent pair of one of the plurality of biconcave electrode groups and one of the plurality of biconvex electrode groups are connected to a same one of the plurality of first signal lines but two different ones of the plurality of second signal lines; a second directly adjacent pair of one of the plurality of biconcave electrode groups and one of the plurality of biconvex electrode groups are connected to a same one of the plurality of second signal lines but two different ones of the plurality of first signal lines; and the first directly adjacent pair and the second directly adjacent pair have at least one electrode in common.

Optionally, each individual one of the plurality of first signal lines is connected to a respective one of the plurality of biconcave electrode groups and a respective one of the plurality of biconvex electrode groups directly adjacent to each other; each individual one of the plurality of second signal lines is connected to a respective one of the plurality of biconcave electrode groups and a respective one of the plurality of biconvex electrode groups directly adjacent to each other; each individual one of the plurality of biconcave electrode groups is connected to a respective one of the plurality of first signal lines and a respective one of the plurality of second signal lines; and each individual one of the plurality of biconvex electrode groups is connected to a respective one of the plurality of first signal lines and a respective one of the plurality of second signal lines.

Optionally, the plurality of biconcave electrode groups have a substantially uniform overall shape; and the plurality of biconvex electrode groups have a substantially uniform overall shape.

Optionally, each individual one of the plurality of discrete electrodes has a boundary substantially complementary to, and insulated from, corresponding portions of directly adjacent one or more of the plurality of the plurality of discrete electrodes.

Optionally, each individual group of the plurality of first electrode groups has a boundary substantially complementary to, and insulated from, corresponding portions of directly adjacent one or more groups of the plurality of second electrode groups; and each individual group of the plurality of second electrode groups has a boundary substantially complementary to, and insulated from, corresponding portions of directly adjacent one or more groups of the plurality of first electrode groups.

Optionally, numbers of discrete electrodes in each individual group of the plurality of first electrode groups is equal to or greater than 2; and numbers of discrete electrodes in each individual group of the plurality of second electrode groups is equal to or greater than 2.

Optionally, the digital microfluidic device further comprises a dielectric insulating layer on a side of the electrode array distal to the base substrate, and configured to insulate the plurality of discrete electrodes from each other; and a hydrophobic layer on a side of the dielectric insulating layer distal to the base substrate.

In another aspect, the present invention provides a microfluidic device comprising the digital microfluidic device described herein or fabricated by a method described herein.

In another aspect, the present invention provides a lab-on-a-chip device comprising the digital microfluidic device described herein or fabricated by a method described herein.

In another aspect, the present invention provides a digital microfluidic method, comprising selectively transporting a liquid droplet using the digital microfluidic device described herein or fabricated by a method described herein; wherein the digital microfluidic device comprises a base substrate; and an electrode array including a plurality of discrete electrodes on the base substrate; wherein the plurality of discrete electrodes can be grouped into a plurality of first electrode groups, each of which comprising a plurality of directly adjacent discrete electrodes; a cross-section of each individual group of the plurality of first electrode groups along a plane substantially parallel to a main surface of the base substrate has an overall shape having a recess on one side, and a protrusion on an opposite side protruding toward a first direction; the plurality of discrete electrodes can be alternatively grouped into a plurality of second electrode groups, each of which comprising a plurality of directly adjacent discrete electrodes; a cross-section of each individual group of the plurality of second electrode groups along the plane substantially parallel to the main surface of the base substrate has an overall shape having a recess on one side, and a protrusion on an opposite side protruding toward a second direction; the first direction and the second direction are different from each other; the method comprises in a forward mode, sequentially actuating and de-actuating the plurality of first electrode groups one group after another, thereby transporting the liquid droplet on a side of the electrode array distal to the base substrate along a forward direction; and in a backward mode, sequentially actuating and de-actuating the plurality of second electrode groups one group after another, thereby transporting the liquid droplet on a side of the electrode array distal to the base substrate along a backward direction, the backward direction being different from the forward direction.

Optionally, the digital microfluidic device further comprises a plurality of first signal lines and a plurality of second signal lines; wherein the plurality of first signal lines are respectively connected to the plurality of first electrode groups, each individual one of the plurality of first signal lines being connected to all of directly adjacent discrete electrodes in a respective one of the plurality of first electrode groups; and the plurality of second signal lines are respectively connected to the plurality of second electrode groups, each individual one of the plurality of second signal lines being connected to all of directly adjacent discrete electrodes in a respective one of the plurality of second electrode groups; the method comprises in the forward mode, sequentially providing an actuating voltage to the plurality of first signal lines, thereby transporting the liquid droplet on a side of the electrode array distal to the base substrate along the forward direction; and in the backward mode, sequentially providing an actuating voltage to the plurality of second signal lines, thereby transporting the liquid droplet on a side of the electrode array distal to the base substrate along the backward direction.

Optionally, the plurality of discrete electrodes comprise a plurality of biconcave electrode groups and a plurality of biconvex electrode groups alternately arranged; a cross-section of each individual one of the plurality of biconcave electrode groups along the plane substantially parallel to the main surface of the base substrate has an overall shape of a biconcave shape; and a cross-section of each individual one of the plurality of biconvex electrode groups along the plane substantially parallel to the main surface of the base substrate has an overall shape of a biconvex shape; the method comprises selectively actuating and de-actuating directly adjacent pairs of one of the plurality of biconcave electrode groups and one of the plurality of biconvex electrode groups one pair after another, thereby transporting the liquid droplet on a side of the electrode array distal to the base substrate.

Optionally, the digital microfluidic device further comprises a plurality of first signal lines and a plurality of second signal lines; wherein a first directly adjacent pair of one of the plurality of biconcave electrode groups and one of the plurality of biconvex electrode groups are connected to a same one of the plurality of first signal lines but two different ones of the plurality of second signal lines; a second directly adjacent pair of one of the plurality of biconcave electrode groups and one of the plurality of biconvex electrode groups are connected to a same one of the plurality of second signal lines but two different ones of the plurality of first signal lines; and the first directly adjacent pair and the second directly adjacent pair have at least one electrode in common; the method comprises in the forward mode, sequentially providing an actuating voltage to the plurality of first signal lines, thereby transporting the liquid droplet on a side of the electrode array distal to the base substrate along the forward direction; and in the backward mode, sequentially providing an actuating voltage to the plurality of second signal lines, thereby transporting the liquid droplet on a side of the electrode array distal to the base substrate along the backward direction.

In another aspect, the present invention provides a method of fabricating a digital microfluidic device, comprising forming an electrode array including a plurality of discrete electrodes on a base substrate; wherein the plurality of discrete electrodes can be grouped into a plurality of first electrode groups, each of which comprising a plurality of directly adjacent discrete electrodes; a cross-section of each individual group of the plurality of first electrode groups along a plane substantially parallel to a main surface of the base substrate has an overall shape having a recess on one side, and a protrusion on an opposite side protruding toward a first direction; the plurality of discrete electrodes can be alternatively grouped into a plurality of second electrode groups, each of which comprising a plurality of directly adjacent discrete electrodes; a cross-section of each individual group of the plurality of second electrode groups along the plane substantially parallel to the main surface of the base substrate has an overall shape having a recess on one side, and a protrusion on an opposite side protruding toward a second direction; the first direction and the second direction are different from each other.

BRIEF DESCRIPTION OF THE FIGURES

The following drawings are merely examples for illustrative purposes according to various disclosed embodiments and are not intended to limit the scope of the present invention.

DETAILED DESCRIPTION

Figure 1:
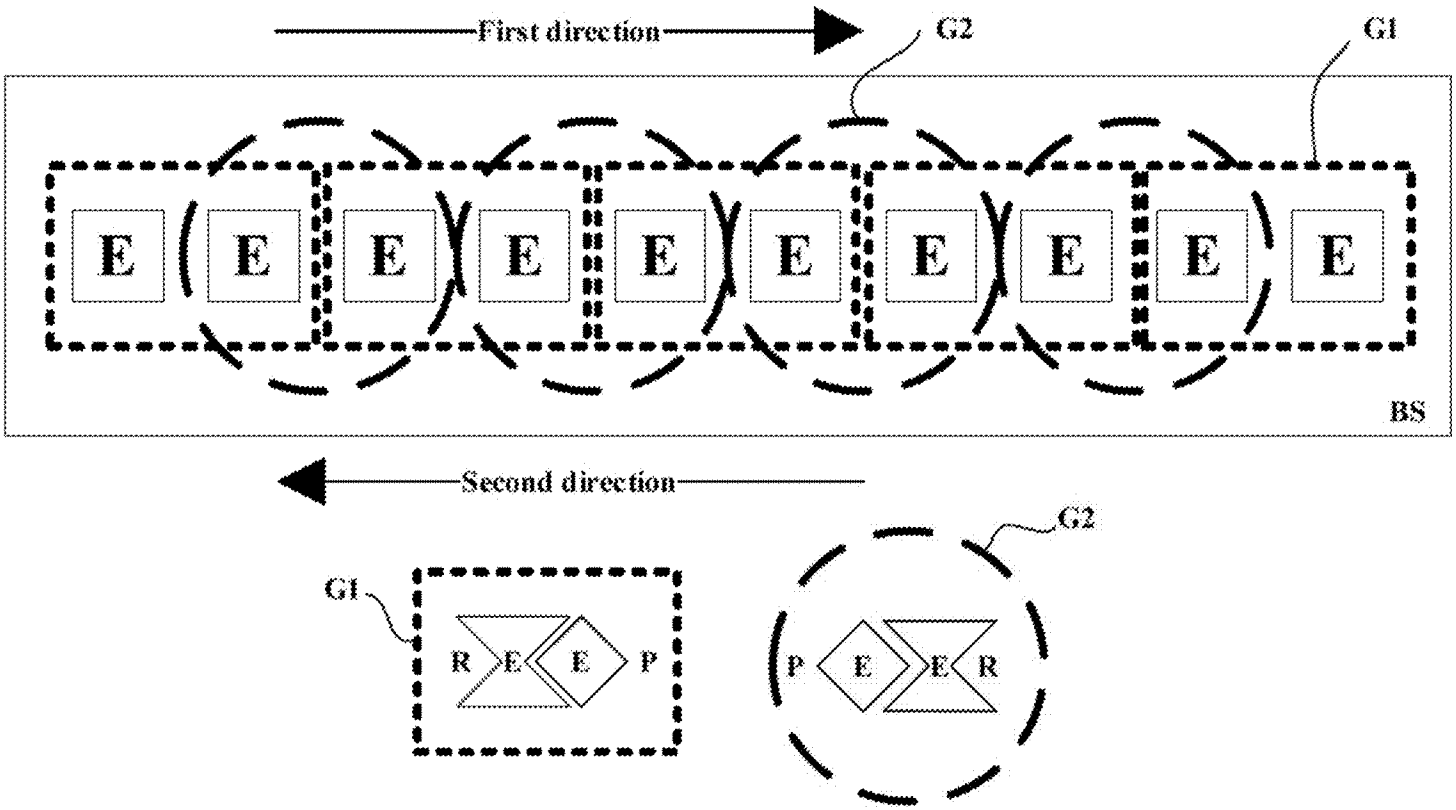
FIG. 1 is a schematic diagram illustrating the structure of a digital microfluidic device in some embodiments according to the present disclosure.

The disclosure will now be described more specifically with reference to the following embodiments. It is to be noted that the following descriptions of some embodiments are presented herein for purpose of illustration and description only. It is not intended to be exhaustive or to be limited to the precise form disclosed.

To manipulate droplets of fluids using digital microfluidics, a driving voltage is required on the electrodes. Typically, a voltage having a level greater than 100 V is needed to effectively manipulate the droplets. As a high voltage may trigger certain side reactions between reagents in the droplets, this presents a limitation to the application of digital microfluidics in certain fields.

In conventional digital microfluidics, the electrodes for driving the droplets are typically made of a square shape. A droplet partially overlaps with a square electrode thereby forming a contact line. Due to the square shape of the electrode, a chord length of the contact line is relatively small, particularly when a volume of the droplet is relative small. When the chord length is relatively small, the driving force for moving the droplet forward is correspondingly relatively small. As a result, a relatively higher driving voltage is required to move the droplet forward. However, a high driving voltage often is associated with a risk of short through a dielectric insulating layer between the droplet and the electrode. Also, as discussed above, a higher driving voltage may trigger undesired side reactions in the droplet.

Accordingly, the present disclosure provides, inter alia, a digital microfluidic device, microfluidic device, a lab-on-a-chip device, a digital microfluidic method, and a method of fabricating a digital microfluidic device that substantially obviate one or more of the problems due to limitations and disadvantages of the related art. In one aspect, the present disclosure provides a digital microfluidic device. In some embodiments, the digital microfluidic device includes a base substrate and an electrode array including a plurality of discrete electrodes continuously arranged on the base substrate. Optionally, the plurality of discrete electrodes can be grouped into a plurality of first electrode groups, each of which including a plurality of directly adjacent discrete electrodes. Optionally, a cross-section of each individual group of the plurality of first electrode groups along a plane substantially parallel to a main surface of the base substrate has an overall shape having a recess on one side, and a protrusion on an opposite side protruding toward a first direction. Optionally, the plurality of discrete electrodes can be alternatively grouped into a plurality of second electrode groups, each of which including a plurality of directly adjacent discrete electrodes. Optionally, a cross-section of each individual group of the plurality of second electrode groups along the plane substantially parallel to the main surface of the base substrate has an overall shape having a recess on one side, and a protrusion on an opposite side protruding toward a second direction. Optionally, the first direction and the second direction are different from each other.

FIG. 1 is a schematic diagram illustrating the structure of a digital microfluidic device in some embodiments according to the present disclosure. FIG. 1 shows a plan view of the digital microfluidic device. Referring to FIG. 1, the digital microfluidic device includes a base substrate BS and an electrode array including a plurality of discrete electrodes E continuously arranged on the base substrate BS. Optionally, the plurality of discrete electrodes E can be grouped into a plurality of first electrode groups G1, and can be alternatively grouped into a plurality of second electrode groups G2. Each of the plurality of first electrode groups G1 includes a plurality of directly adjacent discrete electrodes of the plurality of discrete electrodes E, and each of the plurality of second electrode groups G2 includes a plurality of directly adjacent discrete electrodes of the plurality of discrete electrodes E. Optionally, and referring to the zoom-in picture on bottom left part of FIG. 1, a cross-section of each individual group of the plurality of first electrode groups G1 along a plane substantially parallel to a main surface of the base substrate BS has an overall shape having a recess on one side, and a protrusion on an opposite side protruding toward a first direction. Optionally, and referring to the zoom-in picture on bottom right part of FIG. 1, a cross-section of each individual group of the plurality of second electrode groups G2 along the plane substantially parallel to the main surface of the base substrate BS has an overall shape having a recess on one side, and a protrusion on an opposite side protruding toward a second direction. Optionally, the first direction and the second direction are different from each other. Optionally, the first direction and the second direction are reversed directions, e.g., the first direction and the second direction are reverse to each other. Optionally, the first direction and the second direction are substantially opposite to each other.

Figure 2:
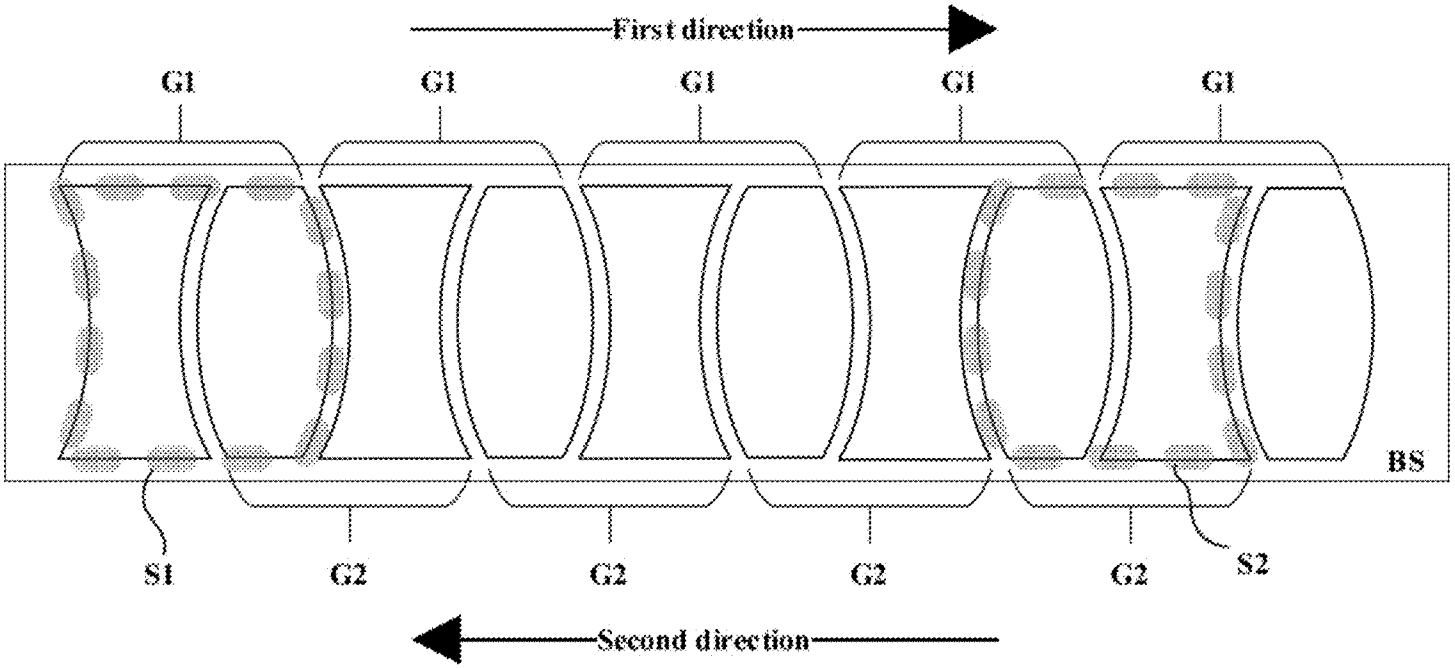
FIG. 2 is a schematic diagram illustrating the structure of a digital microfluidic device in some embodiments according to the present disclosure.

The overall shape of the cross-section of each individual group of the plurality of first electrode groups G1 along a plane substantially parallel to a main surface of the base substrate BS may be of any appropriate shape, as long as the overall shape has a recess on one side, and a protrusion on an opposite side protruding toward the first direction. The overall shape of the cross-section of each individual group of the plurality of second electrode groups G2 along the plane substantially parallel to the main surface of the base substrate BS may be of any appropriate shape, as long as the overall shape has a recess on one side, and a protrusion on an opposite side protruding toward the second direction. FIG. 2 is a schematic diagram illustrating the structure of a digital microfluidic device in some embodiments according to the present disclosure. Referring to FIG. 2, in some embodiments, the cross-section of each individual group of the plurality of first electrode groups along the plane substantially parallel to the main surface of the base substrate has an overall shape of a first convex-concave shape S1 (depicted using thick dotted lines), a convex side of the first convex-concave shape protruding toward the first direction; and the cross-section of each individual group of the plurality of second electrode groups along the plane substantially parallel to the main surface of the base substrate has an overall shape of a second convex-concave shape S2 (depicted using thick dotted lines), a convex side of the second convex-concave shape protruding toward the second direction. As used herein, the term "convex-concave" refers to a shape having one concave side and one convex side, e.g., substantially opposite to each other.

Figure 3:
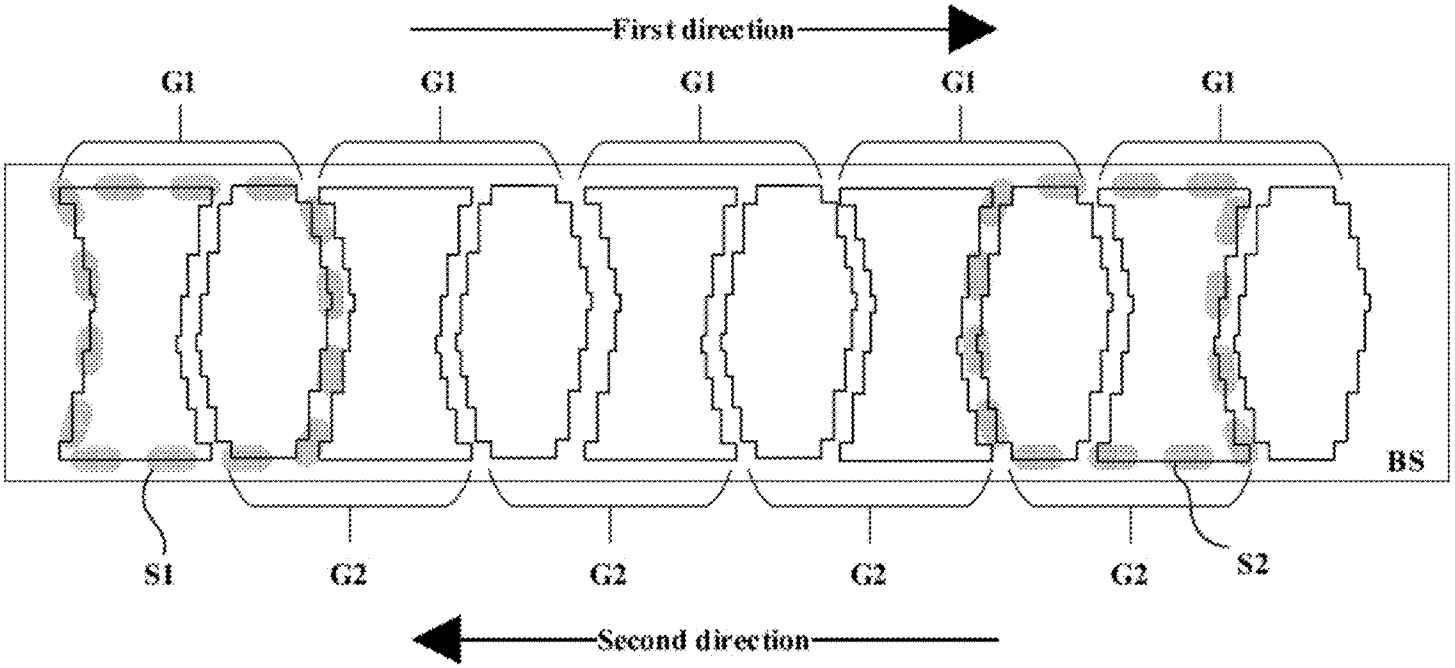
FIG. 3 is a schematic diagram illustrating the structure of a digital microfluidic device in some embodiments according to the present disclosure.

FIG. 3 is a schematic diagram illustrating the structure of a digital microfluidic device in some embodiments according to the present disclosure. Referring to FIG. 3, the overall shape of the cross-section of each individual group of the plurality of first electrode groups G1 along a plane substantially parallel to a main surface of the base substrate BS has a jagged edge, but the overall shape has a recess on one side, and a protrusion on an opposite side protruding toward the first direction. Specifically, the overall shape is approximately a first convex-concave shape S1 (depicted using thick dotted lines), and a convex side of the first convex-concave shape protrudes toward the first direction. Similarly, the overall shape of the cross-section of each individual group of the plurality of second electrode groups G2 along the plane substantially parallel to the main surface of the base substrate BS has a jagged edge, but the overall shape has a recess on one side, and a protrusion on an opposite side protruding toward the second direction. Specifically, the overall shape is approximately a second convex-concave shape S2 (depicted using thick dotted lines), and a convex side of the second convex-concave shape protrudes toward the second direction.

Figure 4:
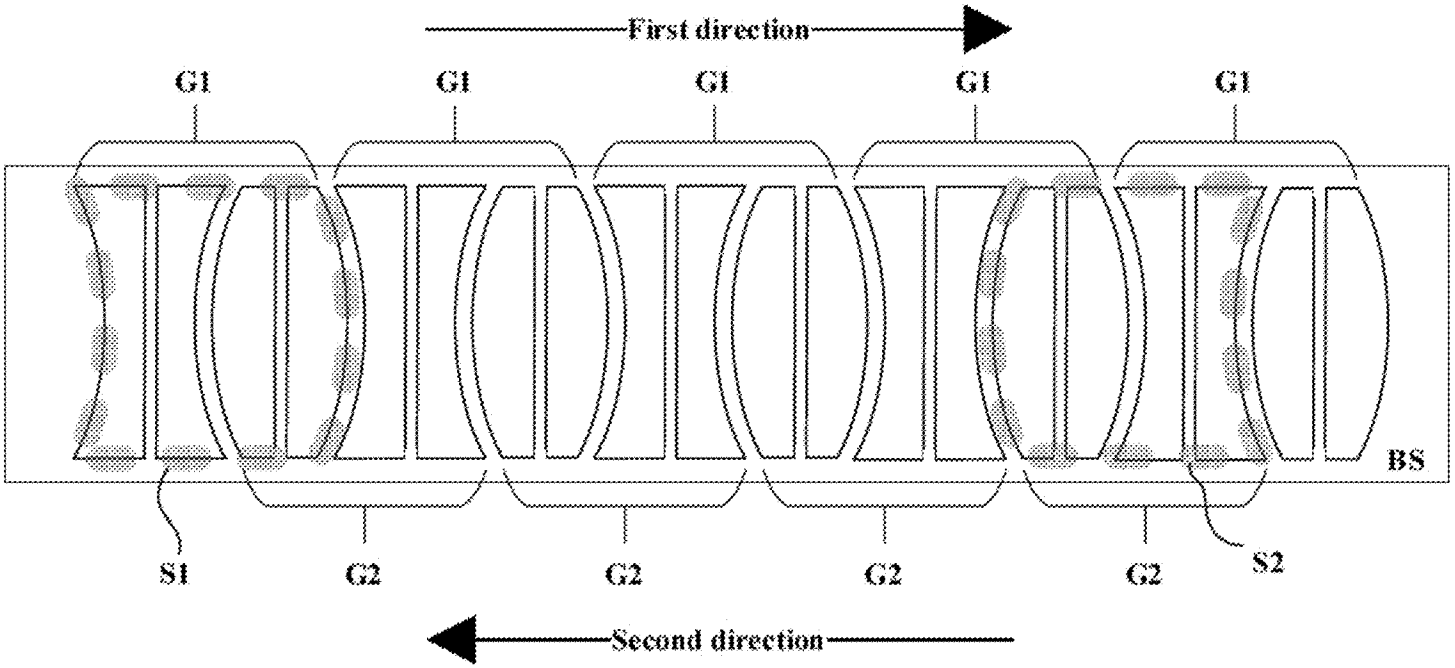
FIG. 4 is a schematic diagram illustrating the structure of a digital microfluidic device in some embodiments according to the present disclosure.

Each individual group of the plurality of first electrode groups G1 can include any appropriate numbers of discrete electrodes, but the numbers of discrete electrodes in each individual group of the plurality of first electrode groups G1 is equal to or greater than 2. Each individual group of the plurality of second electrode groups G2 can include any appropriate numbers of discrete electrodes, but the numbers of discrete electrodes in each individual group of the plurality of second electrode groups G2 is equal to or greater than 2. FIG. 4 is a schematic diagram illustrating the structure of a digital microfluidic device in some embodiments according to the present disclosure. Referring to FIG. 4, each individual group of the plurality of first electrode groups G1 includes four discrete electrodes, and each individual group of the plurality of second electrode groups G2 also includes four discrete electrodes. The cross-section of the four discrete electrodes in each individual group of the plurality of first electrode groups G1 along the plane substantially parallel to the main surface of the base substrate BS has a first convex-concave shape S (depicted using thick dotted lines), and a convex side of the first convex-concave shape protrudes toward the first direction. The cross-section of the four discrete electrodes in each individual group of the plurality of second electrode groups G2 along the plane substantially parallel to the main surface of the base substrate BS has a second convex-concave shape S2 (depicted using thick dotted lines), and a convex side of the second convex-concave shape protrudes toward the second direction.

In some embodiments, each individual one of the plurality of discrete electrodes has a boundary substantially complementary to, and insulated from, corresponding portions of directly adjacent one or more of the plurality of the plurality of discrete electrodes. Optionally, each individual group of the plurality of first electrode groups G1 has a boundary substantially complementary to, and insulated from, corresponding portions of directly adjacent one or more groups of the plurality of second electrode groups G2. Optionally, each individual group of the plurality of second electrode groups G2 has a boundary substantially complementary to, and insulated from, corresponding portions of directly adjacent one or more groups of the plurality of first electrode groups G1.

The plurality of discrete electrodes can be further grouped in another alternative manner. In some embodiments, the plurality of discrete electrodes can be grouped into a plurality of biconcave electrode groups and a plurality of biconvex electrode groups alternately arranged. FIGS. 5A to 5D are schematic diagrams illustrating the structures of digital microfluidic devices in some embodiments according to the present disclosure. Referring to FIGS. 5A to 5D, the plurality of discrete electrodes in some embodiments are grouped into a plurality of biconcave electrode groups G3 and a plurality of biconvex electrode groups G4 alternately arranged. For example, each individual one group of the plurality of biconcave electrode groups G3 is directly adjacent to one or more groups of the plurality of biconvex electrode groups G4, and each individual one group of the plurality of biconvex electrode groups G4 is directly adjacent to one or more groups of the plurality of biconcave electrode groups G3. Optionally, any individual one group of the plurality of biconcave electrode groups G3 is not directly adjacent to another group of the plurality of biconcave electrode groups G3. Optionally, any individual one group of the plurality of biconvex electrode groups G4 is not directly adjacent to another group of the plurality of biconvex electrode groups G4.

Figure 5A:
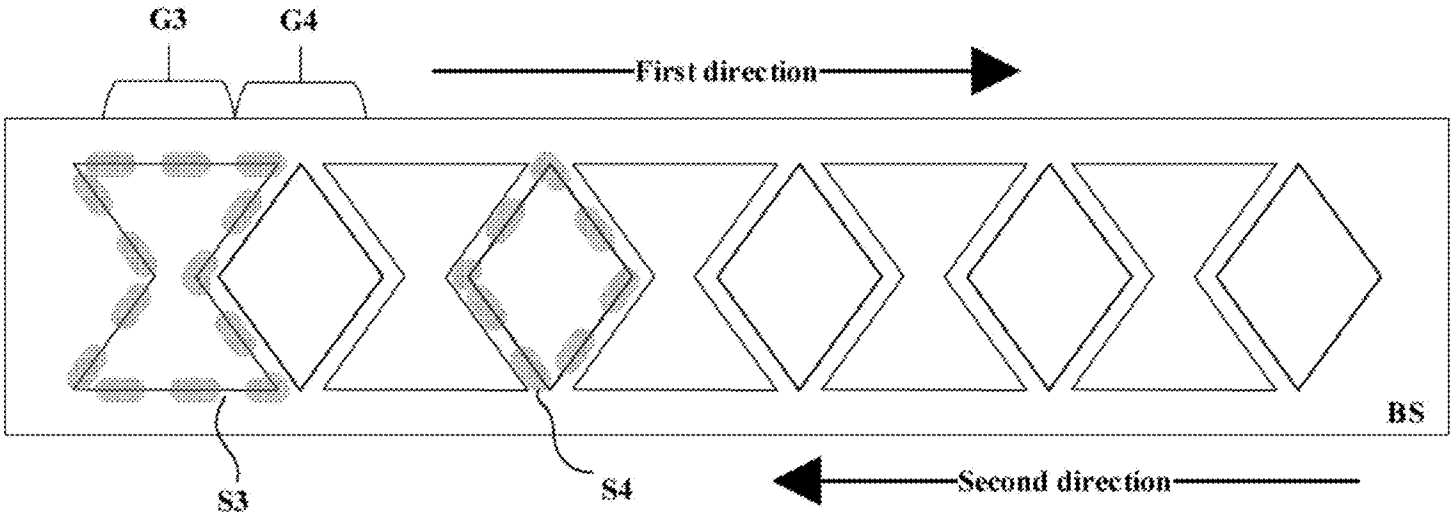
FIGS. 5A to 5D are schematic diagrams illustrating the structures of digital microfluidic devices in some embodiments according to the present disclosure.
Figure 5B:
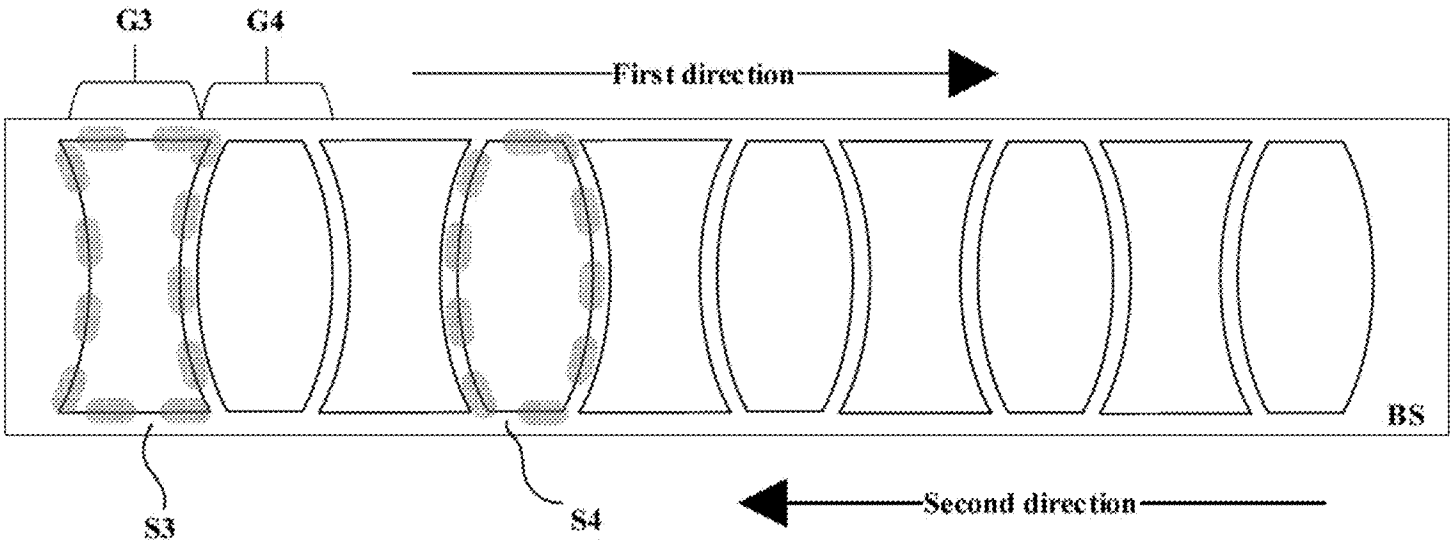
Figure 5C:
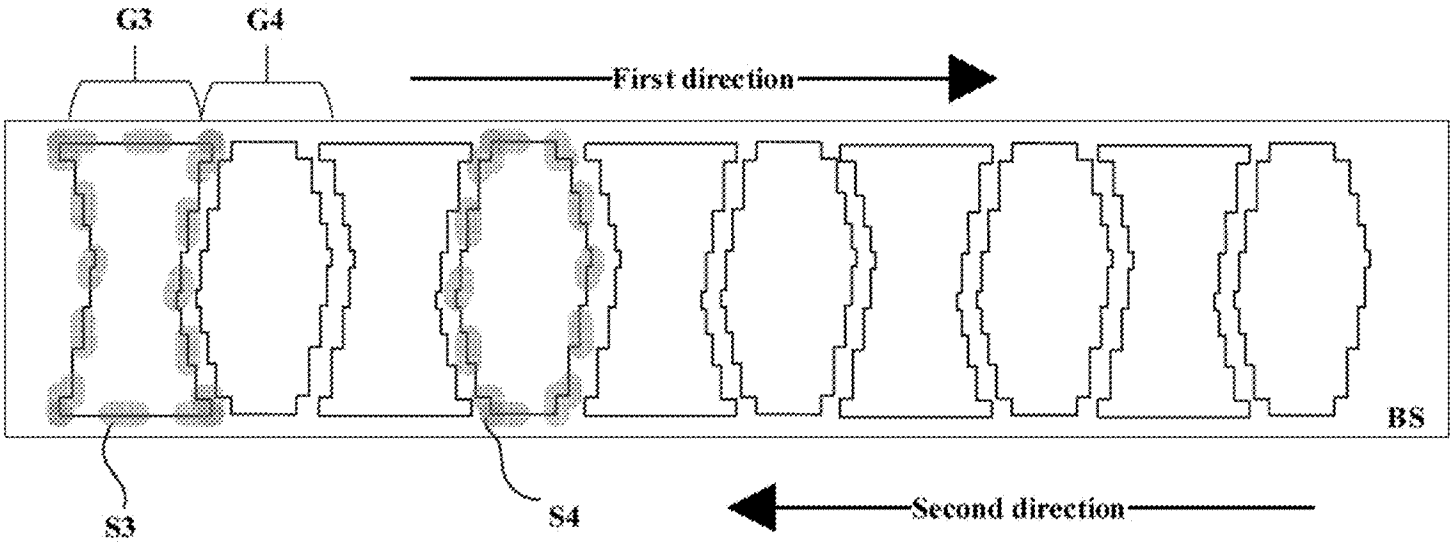
Figure 5D:
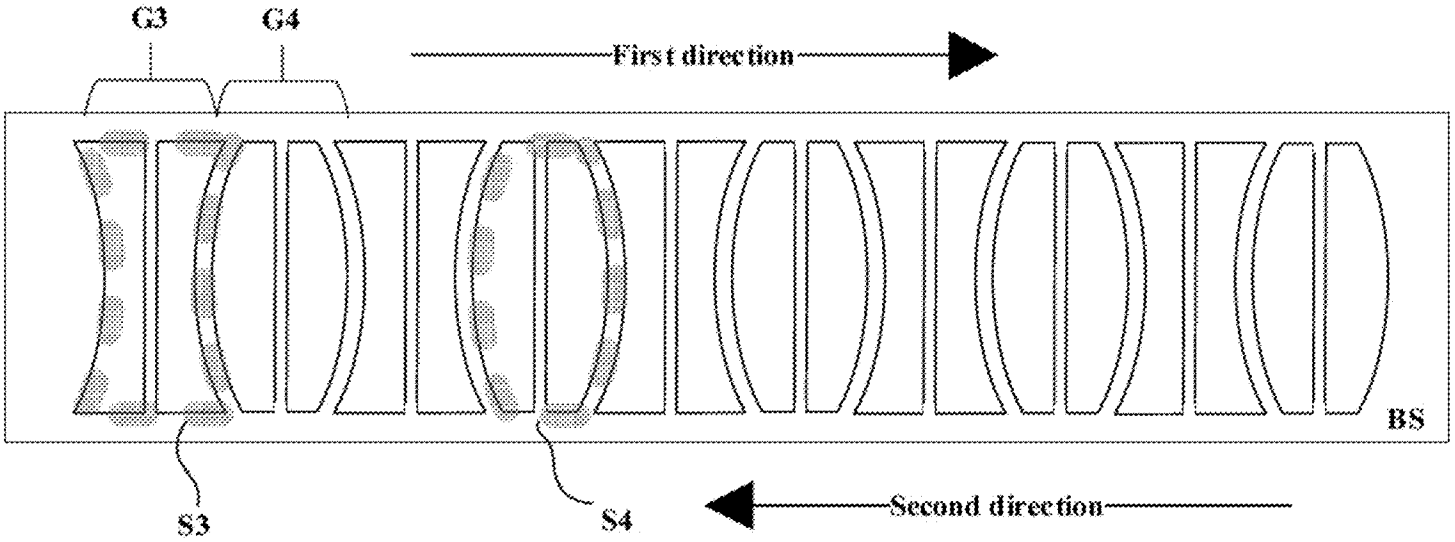

A cross-section of each individual one of the plurality of biconcave electrode groups G3 along the plane substantially parallel to the main surface of the base substrate BS has an overall shape of a biconcave shape S3 (depicted using thick dotted lines). A cross-section of each individual one of the plurality of biconvex electrode groups G4 along the plane substantially parallel to the main surface of the base substrate BS has an overall shape of a biconvex shape S4 (depicted using thick dotted lines). As used herein, the term "biconcave" refers to a shape having two concave sides, e.g., substantially opposite to each other. As used herein, the term "biconvex" refers to a shape having two convex sides, e.g., substantially opposite to each other. Optionally, the biconcave shape S3 has a smooth edge (FIGS. 5A, 5B, and 5D). Optionally, the biconvex shape S4 has a smooth edge (FIGS. 5A, 5B, and 5D). Optionally, the biconcave shape S3 has a jagged edge (FIG. 5C). Optionally, the biconvex shape S4 has a jagged edge (FIG. 5C).

Each individual group of the plurality of biconcave electrode groups G3 can include any appropriate numbers of discrete electrodes, but the numbers of discrete electrodes in each individual group of the plurality of biconcave electrode groups G3 is equal to or greater than 1. Each individual group of the plurality of biconvex electrode groups G4 can include any appropriate numbers of discrete electrodes, but the numbers of discrete electrodes in each individual group of the plurality of biconvex electrode groups G4 is equal to or greater than 1. As shown in FIGS. 5A, 5B, and 5C, each individual one group of the plurality of biconcave electrode groups G3 consists of a single biconcave electrode, and each individual one group of the plurality of biconvex electrode groups G4 consists of a single biconvex electrode. Referring to FIG. 5D, each individual one group of the plurality of biconcave electrode groups G3 includes two discrete electrodes, and each individual one group of the plurality of biconvex electrode groups G4 includes two discrete electrodes. For example, each individual one group of the plurality of biconcave electrode groups G3 includes two discrete electrodes of a plano-concave shape, and each individual one group of the plurality of biconvex electrode groups G4 includes two discrete electrodes of a plano-convex shape. An overall shape of a combination of the two discrete electrodes of the plano-concave shape is a biconcave shape. An overall shape of a combination of the two discrete electrodes of the plano-convex shape is a biconvex shape.

Optionally, each individual one group of the plurality of biconcave electrode groups has a boundary substantially complementary to, and insulated from, corresponding portions of directly adjacent one or more groups of the plurality of biconvex electrode groups. Optionally, each individual one group of the plurality of biconvex electrode groups has a boundary substantially complementary to, and insulated from, corresponding portions of directly adjacent one or more groups of the plurality of biconcave electrode groups.

Figure 6:
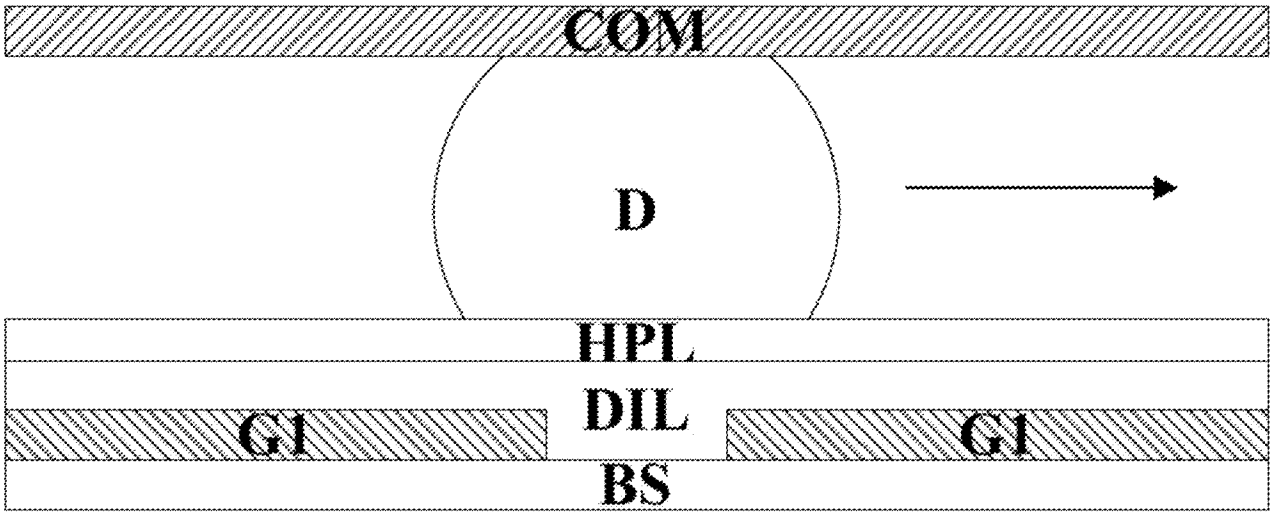
FIG. 6 illustrates a process of transporting a liquid droplet in a digital microfluidic device in some embodiments according to the present disclosure.

FIG. 6 illustrates a process of transporting a liquid droplet in a digital microfluidic device in some embodiments according to the present disclosure. Referring to FIG. 6, the digital microfluidic device in some embodiments further includes a dielectric insulating layer DIL on a side of the electrode array (having the plurality of first electrode groups G1) distal to the base substrate BS, and configured to insulate the plurality of discrete electrodes of the plurality of first electrode groups G1 from each other; and a hydrophobic layer HPL on a side of the dielectric insulating layer DIL distal to the base substrate BS. Optionally, the digital microfluidic device further includes a common electrode COM on a side of the hydrophobic layer HPL distal to the dielectric insulating layer DIL, the common electrode COM being spaced apart from the hydrophobic layer HPL. When a droplet D is disposed on a surface of the hydrophobic layer HPL, the common electrode COM is configured to be provided with a common voltage, e.g., a ground voltage, the plurality of discrete electrodes are sequentially provided with an actuating voltage (e.g., a driving voltage) to transport the droplet D along a path (as indicated by the arrow in FIG. 6). For example, two directly adjacent first electrode groups of the plurality of first electrode groups G1 are shown in FIG. 6. The droplet D is disposed between the two directly adjacent first electrode groups of the plurality of first electrode groups G1. A portion of the droplet D is above one of the two directly adjacent first electrode groups on the right side. When an actuating voltage is applied to the one of the two directly adjacent first electrode groups on the right side, the de-wetting behavior between the droplet D and a surface of the hydrophobic layer HPL above the one of the two directly adjacent first electrode groups on the right side undergoes a change, e.g., becoming less hydrophobic. As the actuating voltage increases, the contact angle of the droplet D on the surface of the hydrophobic layer HPL above the one of the two directly adjacent first electrode groups on the right side decreases. As a result of the change in the de-wetting behavior and the decrease in the contact angle, the droplet D is driven to move toward the right side, e.g., toward the one of the two directly adjacent first electrode groups applied with the actuating voltage. By sequentially applying the actuating voltages respectively to a plurality of first electrode groups G1, the droplet D can be transported along the direction the actuating voltage is applied.

Figure 7:
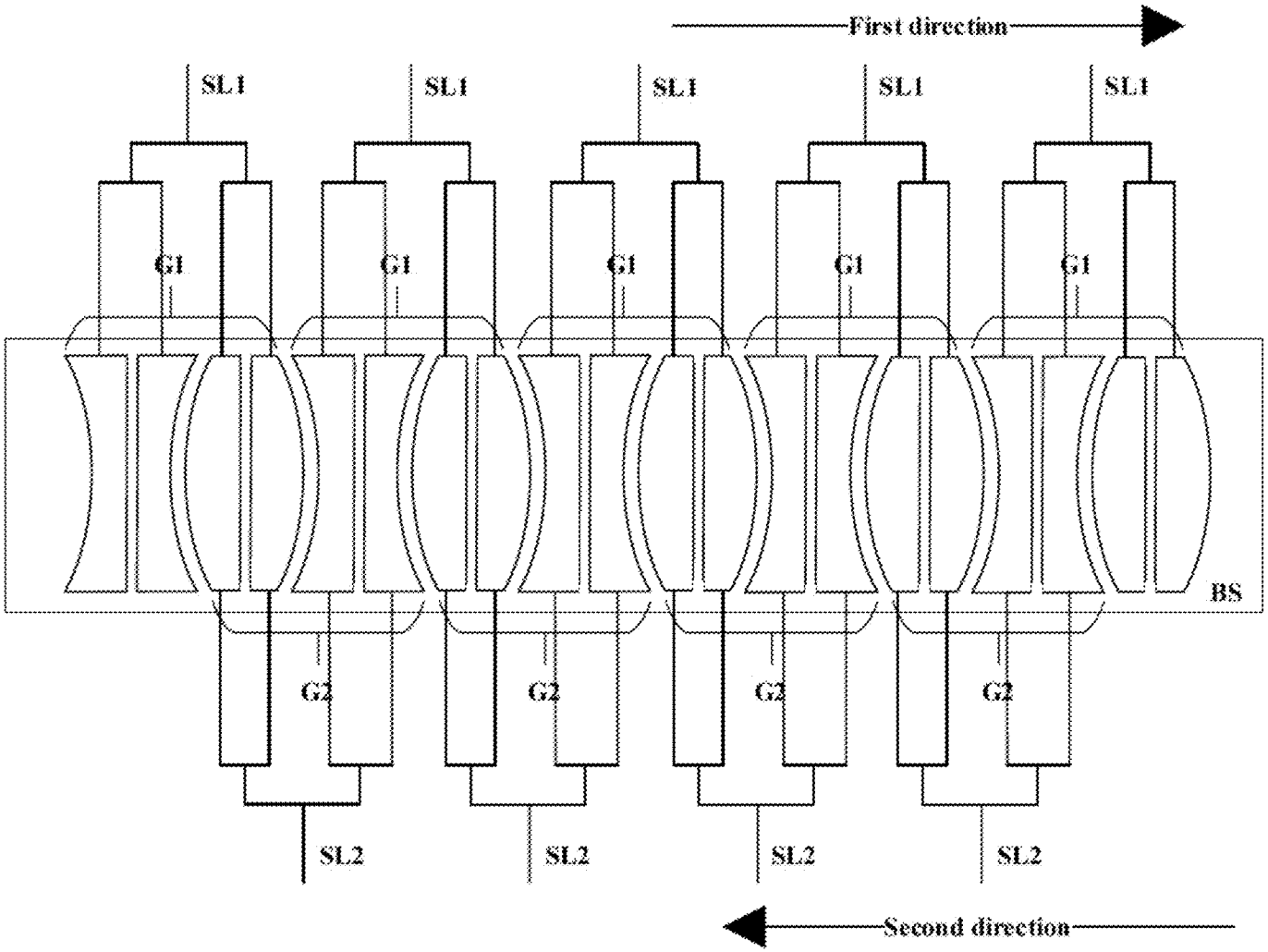
FIG. 7 is a schematic diagram illustrating the structure of a digital microfluidic device in some embodiments according to the present disclosure.

In some embodiments, the digital microfluidic device further includes a plurality of first signal lines and a plurality of second signal lines providing actuating voltages to the electrode array in the digital microfluidic device. FIG. 7 is a schematic diagram illustrating the structure of digital microfluidic device in some embodiments according to the present disclosure. In some embodiments, the plurality of first signal lines SL1 are respectively connected to the plurality of first electrode groups G1, each individual one of the plurality of first signal lines SL1 being connected to all of directly adjacent discrete electrodes in a respective one of the plurality of first electrode groups G1. In some embodiments, the plurality of second signal lines SL2 are respectively connected to the plurality of second electrode groups G2, each individual one of the plurality of second signal lines SL2 being connected to all of directly adjacent discrete electrodes in a respective one of the plurality of second electrode groups G2.

In some embodiments, the droplet on the digital microfluidic device can be transported by sequentially actuating and de-actuating the plurality of first electrode groups G1 one group after another along a forward direction (e.g., the second direction in FIG. 7). In a forward mode, the plurality of first electrode groups G1 are sequentially actuated and de-actuated one by one (e.g., from right to left). As discussed above, the droplet moves toward the one of the plurality of first electrode groups G1 being applied with the actuating voltage. Because the actuating voltage is sequentially applied (and sequentially discontinued) to the plurality of first electrode groups G1 one by one from the right side to the left side, the droplet moves from the right side to the left side.

Figure 8:
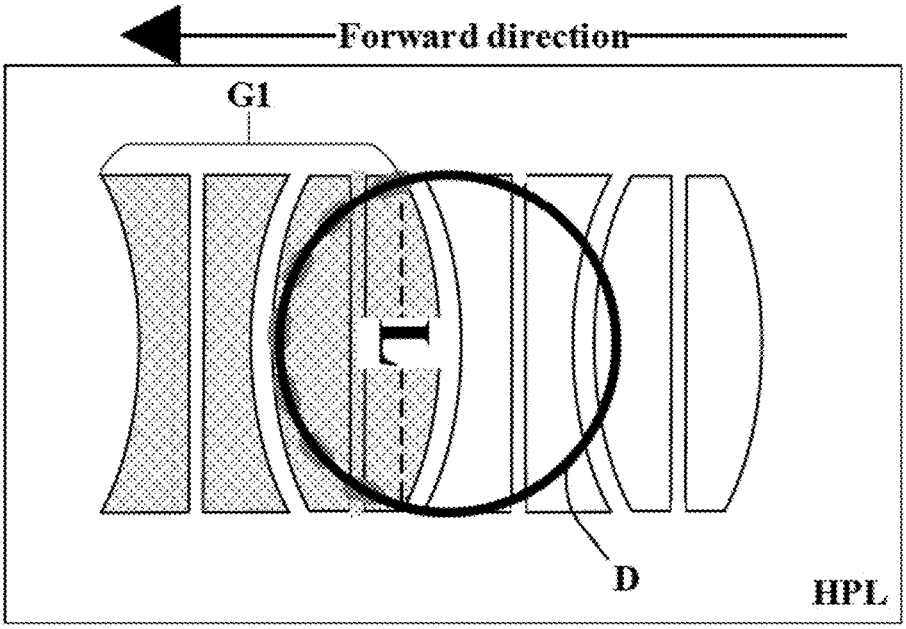
FIG. 8 is a schematic diagram illustrating a contact between a droplet and a hydrophobic surface on an electrode provided with an actuating voltage in some embodiments according to the present disclosure.

FIG. 8 is a schematic diagram illustrating a contact between a droplet and a hydrophobic surface on an electrode provided with an actuating voltage in some embodiments according to the present disclosure. As shown in FIG. 8, an orthographic projection of the droplet D on the hydrophobic layer HPL partially overlaps with an orthographic projection of a plurality of discrete electrode of one of the plurality of first electrode groups G1 on the hydrophobic layer HPL that is applied with an actuating voltage (shown in a dotted pattern), thereby forming a contact line (depicted as the thick dotted line in FIG. 8). A chord length of the contact line is denoted as L in FIG. 8. By moving the droplet D along the forward direction, e.g., a direction toward a side of the one of the plurality of first electrode groups G1 having a protrusion, the chord length L of the contact line of the droplet D can be effectively increased (e.g., as compared to moving toward a side having a recess or a flat side). As shown in FIG. 8, the droplet D is moved toward the convex side of the one of the plurality of first electrode groups G1 (e.g., as compared to moving toward a concave side or a flat side), and the chord length L of the contact line of the droplet D can be effectively increased.

In some embodiments, the droplet on the digital microfluidic device can be transported by sequentially actuating and de-actuating the plurality of second electrode groups G2 one group after another along a backward direction (e.g., the first direction in FIG. 7). In a backward mode, the plurality of second electrode groups G2 are sequentially actuated and de-actuated one by one (e.g., from left to right). The droplet moves toward the one of the plurality of second electrode groups G2 being applied with the actuating voltage. Because the actuating voltage is sequentially applied (and sequentially discontinued) to the plurality of second electrode groups G2 one by one from the left side to the right side, the droplet moves from the left side to the right side.

Figure 9:
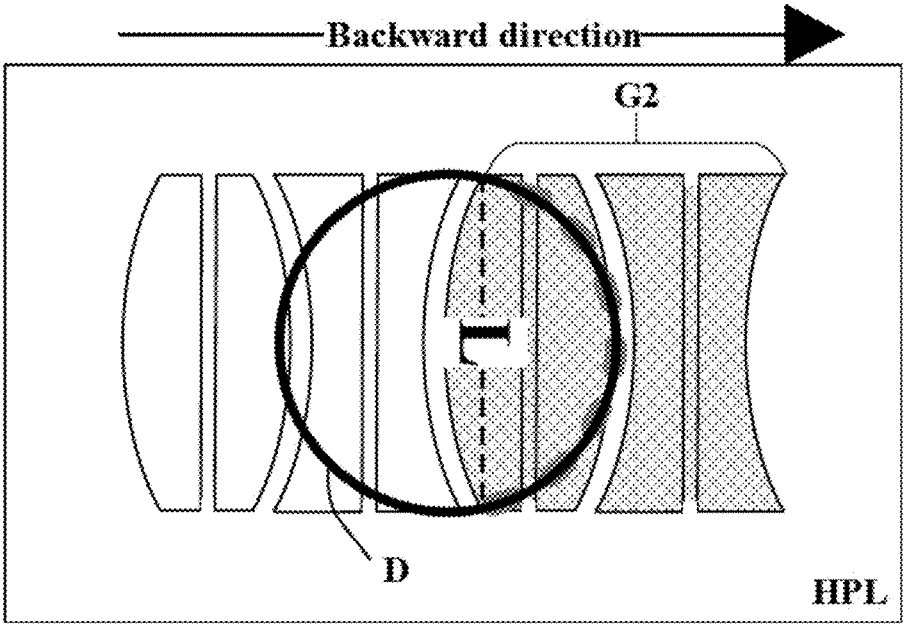
FIG. 9 is a schematic diagram illustrating a contact between a droplet and a hydrophobic surface on an electrode provided with an actuating voltage in some embodiments according to the present disclosure.

FIG. 9 is a schematic diagram illustrating a contact between a droplet and a hydrophobic surface on an electrode provided with an actuating voltage in some embodiments according to the present disclosure. As shown in FIG. 9, an orthographic projection of the droplet D on the hydrophobic layer HPL partially overlaps with an orthographic projection of the plurality of discrete electrode of one of the plurality of second electrode groups G2 on the hydrophobic layer HPL that is applied with an actuating voltage (shown in a dotted pattern), thereby forming a contact line (depicted as the thick dotted line in FIG. 9). A chord length of the contact line is denoted as L in FIG. 9. By moving the droplet D along the backward direction, e.g., a direction toward a side of the one of the plurality of second electrode groups G2 having a protrusion, the chord length L of the contact line of the droplet D can be effectively increased (e.g., as compared to moving toward a side having a recess or a flat side). As shown in FIG. 9, the droplet D is moved toward the convex side of the one of the plurality of second electrode groups G2 (e.g., as compared to moving toward a concave side or a flat side), and the chord length L of the contact line of the droplet D can be effectively increased.

Figure 10:
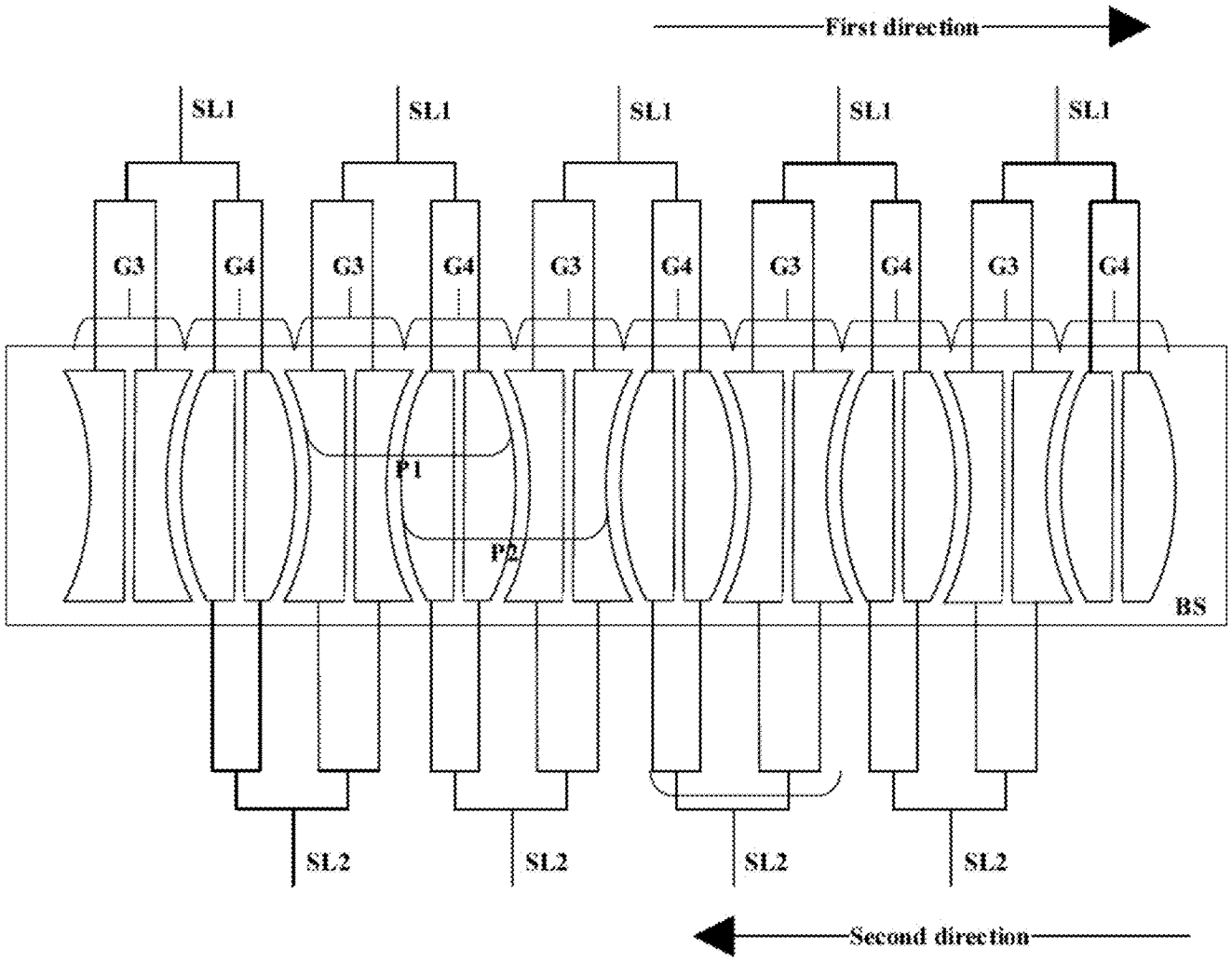
FIG. 10 is a schematic diagram illustrating the structure of a digital microfluidic device in some embodiments according to the present disclosure.

Similarly, the droplet driving mechanism can also be illustrated when the plurality of discrete electrodes are grouped into a plurality of biconcave electrode groups and a plurality of biconvex electrode groups. FIG. 10 is a schematic diagram illustrating the structure of a digital microfluidic device in some embodiments according to the present disclosure. Referring to FIG. 10, the digital microfluidic device includes a plurality of first signal lines SL1 and a plurality of second signal lines SL2. A first directly adjacent pair P1 of one of the plurality of biconcave electrode groups G3 and one of the plurality of biconvex electrode groups G4 are connected to a same one of the plurality of first signal lines SL1 but two different ones of the plurality of second signal lines SL2. A second directly adjacent pair P2 of one of the plurality of biconcave electrode groups G3 and one of the plurality of biconvex electrode groups G4 are connected to a same one of the plurality of second signal lines SL2 but two different ones of the plurality of first signal lines SL1. The first directly adjacent pair P1 and the second directly adjacent pair P2 have at least one electrode in common. Optionally, the first directly adjacent pair P1 and the second directly adjacent pair P2 have one electrode group in common. In one example, the first directly adjacent pair P1 and the second directly adjacent pair P2 have one of the plurality of biconvex electrode groups G4 in common. In another example, the first directly adjacent pair P1 and the second directly adjacent pair P2 have one of the plurality of biconcave electrode groups G3 in common.

Referring to FIG. 10, each individual one of the plurality of first signal lines SL1 is connected to a respective one of the plurality of biconcave electrode groups G3 and a respective one of the plurality of biconvex electrode groups G4 directly adjacent to each other. Each individual one of the plurality of second signal lines SL2 is connected to a respective one of the plurality of biconcave electrode groups G3 and a respective one of the plurality of biconvex electrode groups G4 directly adjacent to each other. Each individual one of the plurality of biconcave electrode groups G3 is connected to a respective one of the plurality of first signal lines SL1 and a respective one of the plurality of second signal lines SL2. Each individual one of the plurality of biconvex electrode groups G4 is connected to a respective one of the plurality of first signal lines SL1 and a respective one of the plurality of second signal lines SL2.

In some embodiments, the droplet on the digital microfluidic device can be transported by sequentially actuating and de-actuating adjacent pairs of one of the plurality of biconcave electrode groups and one of the plurality of biconvex electrode groups one pair after another along a forward direction (e.g., the second direction in FIG. 10). In a forward mode, the adjacent pairs of one of the plurality of biconcave electrode groups G3 and one of the plurality of biconvex electrode groups G4 are sequentially actuated and de-actuated one pair after another (e.g., from right to left). As discussed above, the droplet moves toward the one pair of electrode groups being applied with the actuating voltage. Because the actuating voltage is sequentially applied (and sequentially discontinued) to the plurality of adjacent pairs one pair after another from the right side to the left side, the droplet moves from the right side to the left side.

Figure 11:
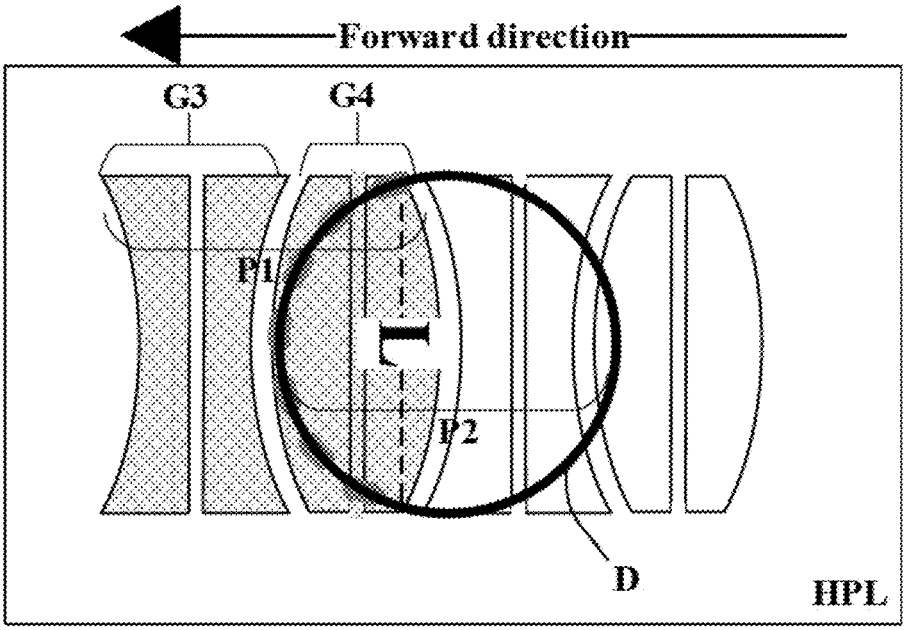
FIG. 11 is a schematic diagram illustrating a contact between a droplet and a hydrophobic surface on an electrode provided with an actuating voltage in some embodiments according to the present disclosure.

FIG. 11 is a schematic diagram illustrating a contact between a droplet and a hydrophobic surface on an electrode provided with an actuating voltage in some embodiments according to the present disclosure. As shown in FIG. 11, an orthographic projection of the droplet D on the hydrophobic layer HPL partially overlaps with an orthographic projection of a plurality of discrete electrodes of one directly adjacent pair of one of the plurality of biconcave electrode groups G3 and one of the plurality of biconvex electrode groups G4 (e.g., a first directly adjacent pair P1) on the hydrophobic layer HPL that is applied with an actuating voltage (shown in a dotted pattern), thereby forming a contact line (depicted as the thick dotted line in FIG. 11). A chord length of the contact line is denoted as L in FIG. 11. By moving the droplet D along the forward direction, e.g., a direction toward a side of the one directly adjacent pair of the plurality of adjacent pairs (e.g., the first directly adjacent pair P1) having a protrusion, the chord length L of the contact line of the droplet D can be effectively increased (e.g., as compared to moving toward a side having a recess or a flat side). As shown in FIG. 11, the droplet D is moved toward the convex side of the one directly adjacent pair of the plurality of adjacent pairs (e.g., as compared to moving toward a concave side or a flat side), and the chord length L of the contact line of the droplet D can be effectively increased.

In some embodiments, the droplet on the digital microfluidic device can be transported by sequentially actuating and de-actuating adjacent pairs of one of the plurality of biconvex electrode groups and one of the plurality of biconcave electrode groups one pair after another along a backward direction (e.g., the first direction in FIG. 10). In a backward mode, the adjacent pairs of one of the plurality of biconvex electrode groups G4 and one of the plurality of biconcave electrode groups G3 are sequentially actuated and de-actuated one by one (e.g., from left to right). The droplet moves toward one pair of electrode groups being applied with the actuating voltage. Because the actuating voltage is sequentially applied (and sequentially discontinued) to the plurality of adjacent pairs one pair after another from the left side to the right side, the droplet moves from the left side to the right side.

Figure 12:
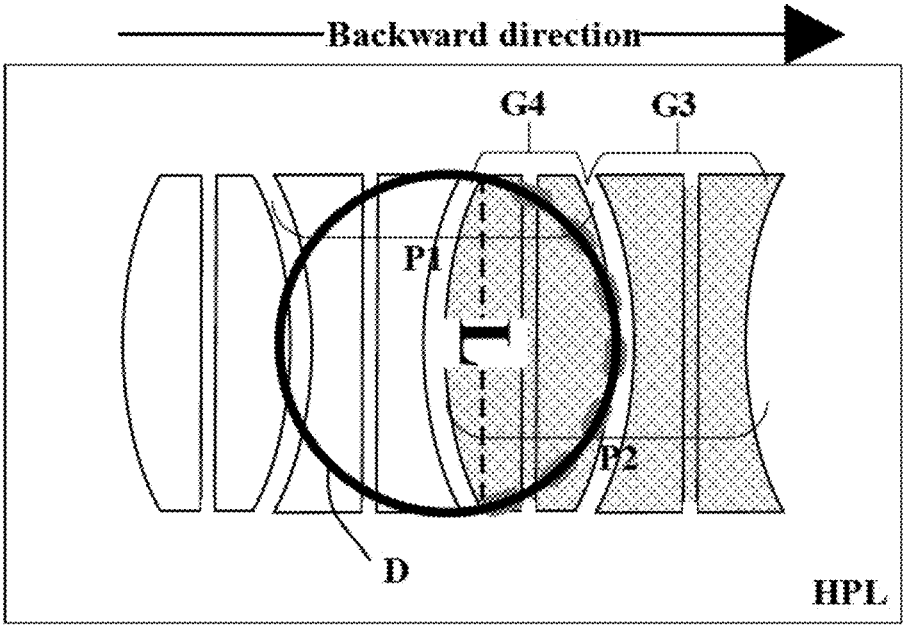
FIG. 12 is a schematic diagram illustrating a contact between a droplet and a hydrophobic surface on an electrode provided with an actuating voltage in some embodiments according to the present disclosure.

FIG. 12 is a schematic diagram illustrating a contact between a droplet and a hydrophobic surface on an electrode provided with an actuating voltage in some embodiments according to the present disclosure. As shown in FIG. 12, an orthographic projection of the droplet D on the hydrophobic layer HPL partially overlaps with an orthographic projection of the plurality of discrete electrode of one directly adjacent pair of one of the plurality of biconvex electrode groups G4 and one of the plurality of biconcave electrode groups G3 (e.g., a second directly adjacent pair P2) on the hydrophobic layer HPL that is applied with an actuating voltage (shown in a dotted pattern), thereby forming a contact line (depicted as the thick dotted line in FIG. 12). A chord length of the contact line is denoted as L in FIG. 12. By moving the droplet D along the backward direction, e.g., a direction toward a side of the one directly adjacent pair of the plurality of adjacent pairs (e.g., the second directly adjacent pair P2) having a protrusion, the chord length L of the contact line of the droplet D can be effectively increased (e.g., as compared to moving toward a side having a recess or a flat side). As shown in FIG. 12, the droplet D is moved toward the convex side of the one directly adjacent pair of the plurality of adjacent pairs (e.g., as compared to moving toward a concave side or a flat side), and the chord length L of the contact line of the droplet D can be effectively increased.

In some embodiments, and referring to FIGS. 5A to 5D, the plurality of biconcave electrode groups have a substantially uniform overall shape, and the plurality of biconvex electrode groups have a substantially uniform overall shape.

Figure 13:
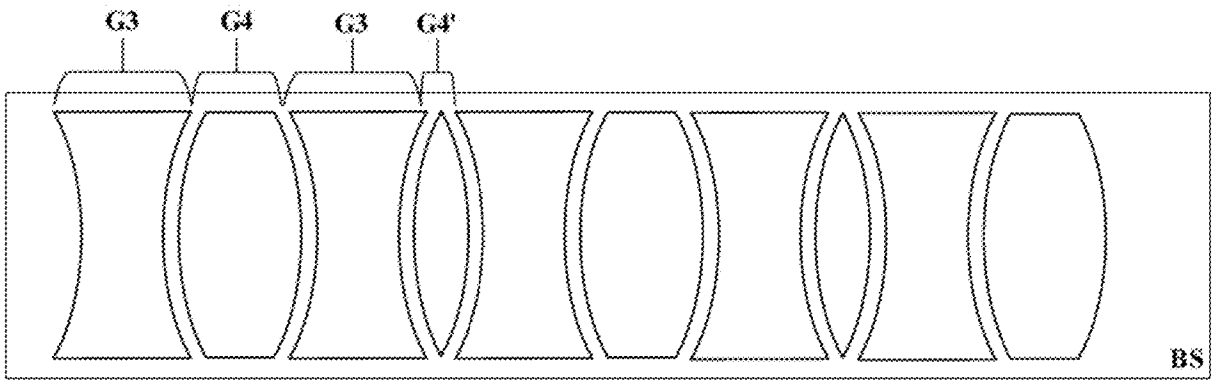
FIG. 13 is a schematic diagram illustrating the structure of a digital microfluidic device in some embodiments according to the present disclosure.

Optionally, the plurality of biconvex electrode groups do not have a substantially uniform overall shape. FIG. 13 is a schematic diagram illustrating the structure of a digital microfluidic device in some embodiments according to the present disclosure. Referring to FIG. 13, the plurality of biconvex electrode groups include two different types of biconvex electrode groups (G4 and G4' respectively).

Figure 14:
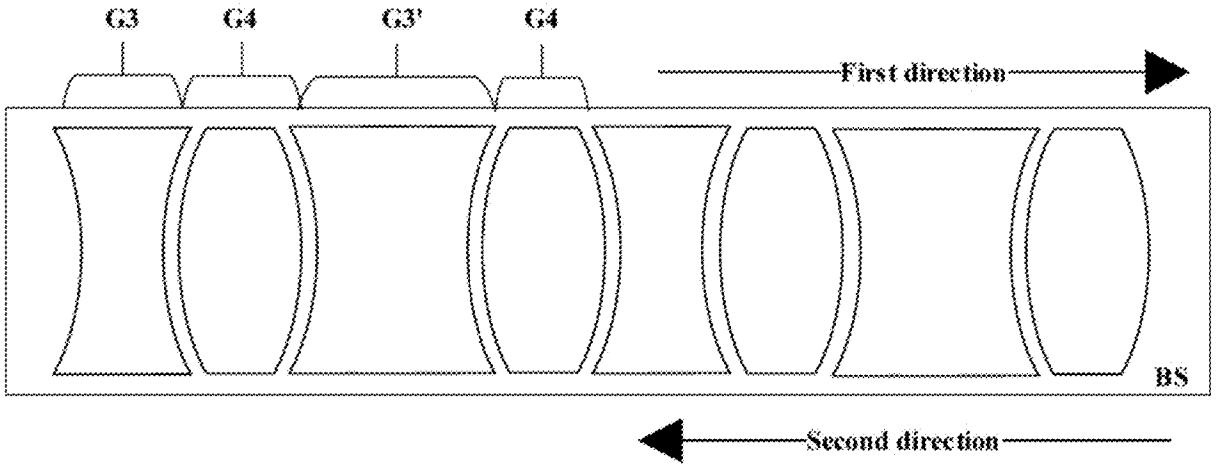

Optionally, the plurality of biconcave electrode groups do not have a substantially uniform overall shape. FIG. 14 is a schematic diagram illustrating the structure of a digital microfluidic device in some embodiments according to the present disclosure. Referring to FIG. 14, the plurality of biconcave electrode groups include two different types of biconvex electrode groups (G3 and G3' respectively).

In some embodiments, each individual one of the plurality of discrete electrodes has a boundary substantially complementary to, and insulated from, corresponding portions of directly adjacent one or more of the plurality of the plurality of discrete electrodes (see, e.g., FIG. 2). Optionally, each individual group of the plurality of first electrode groups has a boundary substantially complementary to, and insulated from, corresponding portions of directly adjacent one or more groups of the plurality of second electrode groups; and each individual group of the plurality of second electrode groups has a boundary substantially complementary to, and insulated from, corresponding portions of directly adjacent one or more groups of the plurality of first electrode groups (see, e.g., FIG. 4). Optionally, each individual group of the plurality of biconcave electrode groups has a boundary substantially complementary to, and insulated from, corresponding portions of directly adjacent one or more groups of the plurality of biconvex electrode groups; and each individual group of the plurality of biconvex electrode groups has a boundary substantially complementary to, and insulated from, corresponding portions of directly adjacent one or more groups of the plurality of biconcave electrode groups (see, e.g., FIG. 5D).

In some embodiments, each of the plurality of discrete electrodes has a dimension (e.g., width or length) in a range of approximately 1 mm to approximately 3 mm, e.g., approximately 2 mm.

In some embodiments, a ratio of a chord length of the contact line of the droplet to a width of electrode (e.g., a width along a direction perpendicular to an extension direction of the plurality of discrete electrodes) is greater than 1.5:2, e.g., greater than 1.6:2, greater than 1.7:2, greater than 1.8:2, greater than 1.9:2, greater than 1.95:2, greater than 1.99:2, and approximately 2:2.

In another aspect, the present disclosure provides a microfluidic device including a digital microfluidic device described herein or fabricated by a method described herein.

In another aspect, the present disclosure provides a lab-on-a-chip device including a digital microfluidic device described herein or fabricated by a method described herein.

In another aspect, the present disclosure provides a digital microfluidic method. In some embodiments, the digital microfluidic method includes selectively transporting a liquid droplet using the digital microfluidic device described herein or fabricated by a method described herein. In some embodiments, the method includes, in a forward mode, sequentially actuating and de-actuating the plurality of first electrode groups one group after another, thereby transporting the liquid droplet on a side of the electrode array distal to the base substrate along a forward direction. In some embodiments, the method includes, in a backward mode, sequentially actuating and de-actuating the plurality of second electrode groups one group after another, thereby transporting the liquid droplet on a side of the electrode array distal to the base substrate along a backward direction. The backward direction is different from the forward direction. Optionally, the forward direction and the backward direction are reversed directions, the forward direction and the backward direction are reverse to each other. Optionally, the forward direction and the backward direction are substantially opposite to each other. Optionally, the method includes, in the forward mode, sequentially providing an actuating voltage to the plurality of first signal lines, thereby transporting the liquid droplet on a side of the electrode array distal to the base substrate along the forward direction. Optionally, the method includes, in the backward mode, sequentially providing an actuating voltage to the plurality of second signal lines, thereby transporting the liquid droplet on a side of the electrode army distal to the base substrate along the backward direction.

In some embodiments, the method includes, selectively actuating and de-actuating directly adjacent pairs of one of the plurality of biconcave electrode groups and one of the plurality of biconvex electrode groups one pair after another, thereby transporting the liquid droplet on a side of the electrode array distal to the base substrate. Optionally, the method includes, in the forward mode, sequentially providing an actuating voltage to the plurality of first signal lines, thereby transporting the liquid droplet on aside of the electrode array distal to the base substrate along the forward direction. Optionally, the method includes, in the backward mode, sequentially providing an actuating voltage to the plurality of second signal lines, thereby transporting the liquid droplet on a side of the electrode array distal to the base substrate along the backward direction.

In another aspect, the present disclosure provides a method of fabricating a digital microfluidic device. In some embodiments, the method includes forming an electrode array including a plurality of discrete electrodes on a base substrate. Optionally, the electrode array is formed so that the plurality of discrete electrodes can be grouped into a plurality of first electrode groups, each of which including a plurality of directly adjacent discrete electrodes; and the plurality of discrete electrodes can be alternatively grouped into a plurality of second electrode groups, each of which including a plurality of directly adjacent discrete electrodes. A cross-section of each individual group of the plurality of first electrode groups along a plane substantially parallel to a main surface of the base substrate has an overall shape having a recess on one side, and a protrusion on an opposite side protruding toward a first direction. A cross-section of each individual group of the plurality of second electrode groups along the plane substantially parallel to the main surface of the base substrate has an overall shape having a recess on one side, and a protrusion on an opposite side protruding toward a second direction. The first direction and the second direction are different from each other.

In some embodiments, the method further includes forming a dielectric insulating layer on a side of the electrode array distal to the base substrate, and configured to insulate the plurality of discrete electrodes from each other; and forming a hydrophobic layer on a side of the dielectric insulating layer distal to the base substrate. Optionally, the method further includes forming a common electrode on a side of the hydrophobic layer distal to the dielectric insulating layer, the common electrode being formed to be spaced apart from the hydrophobic layer.

In some embodiments, the electrode array is formed using a substantially transparent conductive material such as indium tin oxide. Optionally, the step of forming the electrode array including providing a base substrate having an indium tin oxide layer formed thereon (e.g., an "ITO glass"), followed by patterning the indium tin oxide layer to form the electrode array.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A digital microfluidic device, comprising:

a base substrate; and an electrode array including a plurality of discrete electrodes continuously arranged on the base substrate;

wherein the plurality of discrete electrodes are grouped into a plurality of first electrode groups, each of which comprising a plurality of directly adjacent discrete electrodes;

a cross-section of each individual group of the plurality of first electrode groups along a plane substantially parallel to a main surface of the base substrate has an overall shape having a recess on one side, and a protrusion on an opposite side protruding toward a first direction;

the plurality of discrete electrodes are alternatively grouped into a plurality of second electrode groups, each of which comprising a plurality of directly adjacent discrete electrodes;

a cross-section of each individual group of the plurality of second electrode groups along the plane substantially parallel to the main surface of the base substrate has an overall shape having a recess on one side, and a protrusion on an opposite side protruding toward a second direction;

the first direction and the second direction are different from each other;

the plurality of discrete electrodes are alternatively grouped into a plurality of biconcave electrode groups and a plurality of biconvex electrode groups alternately arranged;

a cross-section of each individual one of the plurality of biconcave electrode groups along the plane substantially parallel to the main surface of the base substrate has an overall shape of a biconcave shape; and a cross-section of each individual one of the plurality of biconvex electrode groups along the plane substantially parallel to the main surface of the base substrate has an overall shape of a biconvex shape.

2. The digital microfluidic device of claim 1, wherein the cross-section of each individual group of the plurality of first electrode groups along the plane substantially parallel to the main surface of the base substrate has an overall shape of a first convex-concave shape, a convex side of the first convex-concave shape protruding toward the first direction; and the cross-section of each individual group of the plurality of second electrode groups along the plane substantially parallel to the main surface of the base substrate has an overall shape of a second convex-concave shape, a convex side of the second convex-concave shape protruding toward the second direction.

3. The digital microfluidic device of claim 1, wherein each individual one group of the plurality of biconcave electrode groups is directly adjacent to one or more groups of the plurality of biconvex electrode groups; and each individual one group of the plurality of biconvex electrode groups is directly adjacent to one or more groups of the plurality of biconcave electrode groups.

4. The digital microfluidic device of claim 3, wherein each individual one group of the plurality of biconcave electrode groups has a boundary substantially complementary to, and insulated from, corresponding portions of directly adjacent one or more groups of the plurality of biconvex electrode groups; and each individual one group of the plurality of biconvex electrode groups has a boundary substantially complementary to, and insulated from, corresponding portions of directly adjacent one or more groups of the plurality of biconcave electrode groups.

5. The digital microfluidic device of claim 1, wherein each individual one group of the plurality of biconcave electrode groups consists of a single biconcave electrode; and each individual one group of the plurality of biconvex electrode groups consists of a single biconvex electrode.

6. The digital microfluidic device of claim 1, wherein each individual one group of the plurality of biconcave electrode groups has a boundary substantially complementary to, and insulated from, corresponding portions of directly adjacent one or more groups of the plurality of biconvex electrode groups; and each individual one group of the plurality of biconvex electrode groups has a boundary substantially complementary to, and insulated from, corresponding portions of directly adjacent one or more groups of the plurality of biconcave electrode groups.

7. The digital microfluidic device of claim 1, further comprising a plurality of first signal lines and a plurality of second signal lines;

wherein the plurality of first signal lines are respectively connected to the plurality of first electrode groups, each individual one of the plurality of first signal lines being connected to all of directly adjacent discrete electrodes in a respective one of the plurality of first electrode groups; and the plurality of second signal lines are respectively connected to the plurality of second electrode groups, each individual one of the plurality of second signal lines being connected to all of directly adjacent discrete electrodes in a respective one of the plurality of second electrode groups.

8. The digital microfluidic device of claim 1, further comprising a plurality of first signal lines and a plurality of second signal lines;

wherein a first directly adjacent pair of one of the plurality of biconcave electrode groups and one of the plurality of biconvex electrode groups are connected to a same one of the plurality of first signal lines but two different ones of the plurality of second signal lines;

a second directly adjacent pair of one of the plurality of biconcave electrode groups and one of the plurality of biconvex electrode groups are connected to a same one of the plurality of second signal lines but two different ones of the plurality of first signal lines; and the first directly adjacent pair and the second directly adjacent pair have at least one electrode in common.

9. The digital microfluidic device of claim 8, wherein each individual one of the plurality of first signal lines is connected to a respective one of the plurality of biconcave electrode groups and a respective one of the plurality of biconvex electrode groups directly adjacent to each other;

each individual one of the plurality of second signal lines is connected to a respective one of the plurality of biconcave electrode groups and a respective one of the plurality of biconvex electrode groups directly adjacent to each other;

each individual one of the plurality of biconcave electrode groups is connected to a respective one of the plurality of first signal lines and a respective one of the plurality of second signal lines; and each individual one of the plurality of biconvex electrode groups is connected to a respective one of the plurality of first signal lines and a respective one of the plurality of second signal lines.

10. The digital microfluidic device of claim 1, wherein the plurality of biconcave electrode groups have a substantially uniform overall shape; and the plurality of biconvex electrode groups have a substantially uniform overall shape.

11. The digital microfluidic device of claim 1, wherein each individual one of the plurality of discrete electrodes has a boundary substantially complementary to, and insulated from, corresponding portions of directly adjacent one or more of the plurality of the plurality of discrete electrodes.

12. The digital microfluidic device of claim 1, wherein each individual group of the plurality of first electrode groups has a boundary substantially complementary to, and insulated from, corresponding portions of directly adjacent one or more groups of the plurality of second electrode groups; and each individual group of the plurality of second electrode groups has a boundary substantially complementary to, and insulated from, corresponding portions of directly adjacent one or more groups of the plurality of first electrode groups.

13. A microfluidic device, comprising the digital microfluidic device of claim 1.

14. A lab-on-a-chip device, comprising the digital microfluidic device of claim 1.

15. A digital microfluidic method, comprising selectively transporting a liquid droplet using the digital microfluidic device of claim 1;

wherein the digital microfluidic device comprises:

a base substrate; and an electrode array including a plurality of discrete electrodes on the base substrate;

wherein the plurality of discrete electrodes are grouped into a plurality of first electrode groups, each of which comprising a plurality of directly adjacent discrete electrodes;

a cross-section of each individual group of the plurality of first electrode groups along a plane substantially parallel to a main surface of the base substrate has an overall shape having a recess on one side, and a protrusion on an opposite side protruding toward a first direction;

the plurality of discrete electrodes are alternatively grouped into a plurality of second electrode groups, each of which comprising a plurality of directly adjacent discrete electrodes;

a cross-section of each individual group of the plurality of second electrode groups along the plane substantially parallel to the main surface of the base substrate has an overall shape having a recess on one side, and a protrusion on an opposite side protruding toward a second direction;

the first direction and the second direction are different from each other;

the method comprises:

in a forward mode, sequentially actuating and de-actuating the plurality of first electrode groups one group after another, thereby transporting the liquid droplet on a side of the electrode array distal to the base substrate along a forward direction; and in a backward mode, sequentially actuating and de-actuating the plurality of second electrode groups one group after another, thereby transporting the liquid droplet on a side of the electrode array distal to the base substrate along a backward direction, the backward direction being different from the forward direction;

wherein the plurality of discrete electrodes comprise a plurality of biconcave electrode groups and a plurality of biconvex electrode groups alternately arranged;

a cross-section of each individual one of the plurality of biconcave electrode groups along the plane substantially parallel to the main surface of the base substrate has an overall shape of a biconcave shape; and a cross-section of each individual one of the plurality of biconvex electrode groups along the plane substantially parallel to the main surface of the base substrate has an overall shape of a biconvex shape;

wherein the method comprises selectively actuating and de-actuating directly adjacent pairs of one of the plurality of biconcave electrode groups and one of the plurality of biconvex electrode groups one pair after another, thereby transporting the liquid droplet on a side of the electrode array distal to the base substrate.

16. The digital microfluidic method of claim 15, wherein the digital microfluidic device further comprises a plurality of first signal lines and a plurality of second signal lines;

wherein the plurality of first signal lines are respectively connected to the plurality of first electrode groups, each individual one of the plurality of first signal lines being connected to all of directly adjacent discrete electrodes in a respective one of the plurality of first electrode groups; and the plurality of second signal lines are respectively connected to the plurality of second electrode groups, each individual one of the plurality of second signal lines being connected to all of directly adjacent discrete electrodes in a respective one of the plurality of second electrode groups;

the method comprises:

in the forward mode, sequentially providing an actuating voltage to the plurality of first signal lines, thereby transporting the liquid droplet on a side of the electrode array distal to the base substrate along the forward direction; and in the backward mode, sequentially providing an actuating voltage to the plurality of second signal lines, thereby transporting the liquid droplet on a side of the electrode array distal to the base substrate along the backward direction.

17. The digital microfluidic method of claim 15, wherein the digital microfluidic device further comprises a plurality of first signal lines and a plurality of second signal lines;

wherein a first directly adjacent pair of one of the plurality of biconcave electrode groups and one of the plurality of biconvex electrode groups are connected to a same one of the plurality of first signal lines but two different ones of the plurality of second signal lines;

a second directly adjacent pair of one of the plurality of biconcave electrode groups and one of the plurality of biconvex electrode groups are connected to a same one of the plurality of second signal lines but two different ones of the plurality of first signal lines; and the first directly adjacent pair and the second directly adjacent pair have at least one electrode in common;

the method comprises:

in the forward mode, sequentially providing an actuating voltage to the plurality of first signal lines, thereby transporting the liquid droplet on a side of the electrode array distal to the base substrate along the forward direction; and in the backward mode, sequentially providing an actuating voltage to the plurality of second signal lines, thereby transporting the liquid droplet on a side of the electrode array distal to the base substrate along the backward direction.

18. A method of fabricating a digital microfluidic device, comprising:

forming an electrode array including a plurality of discrete electrodes on a base substrate;

wherein the plurality of discrete electrodes are grouped into a plurality of first electrode groups, each of which comprising a plurality of directly adjacent discrete electrodes;

a cross-section of each individual group of the plurality of first electrode groups along a plane substantially parallel to a main surface of the base substrate has an overall shape having a recess on one side, and a protrusion on an opposite side protruding toward a first direction;

the plurality of discrete electrodes are alternatively grouped into a plurality of second electrode groups, each of which comprising a plurality of directly adjacent discrete electrodes;

a cross-section of each individual group of the plurality of second electrode groups along the plane substantially parallel to the main surface of the base substrate has an overall shape having a recess on one side, and a protrusion on an opposite side protruding toward a second direction;

the first direction and the second direction are different from each other, the plurality of discrete electrodes are alternatively grouped into a plurality of biconcave electrode groups and a plurality of biconvex electrode groups alternately arranged;

a cross-section of each individual one of the plurality of biconcave electrode groups along the plane substantially parallel to the main surface of the base substrate has an overall shape of a biconcave shape; and a cross-section of each individual one of the plurality of biconvex electrode groups along the plane substantially parallel to the main surface of the base substrate has an overall shape of a biconvex shape.

* * * * *